US006752549B2

(12) United States Patent
Silverbrook

(10) Patent No.: US 6,752,549 B2
(45) Date of Patent: Jun. 22, 2004

(54) PRINT ENGINE FOR A MODULAR COMMERCIAL PRINTER

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 10/202,020

(22) Filed: Jul. 25, 2002

(65) Prior Publication Data

US 2003/0059245 A1 Mar. 27, 2003

Related U.S. Application Data

(63) Continuation of application No. 09/662,210, filed on Sep. 15, 2000.

(51) Int. Cl.[7] ..... B41J 2/01

(52) U.S. Cl. ..... 400/188; 347/13; 347/20; 347/42; 347/47

(58) Field of Search ..... 400/188; 347/12, 347/13, 20, 40, 42, 47, 49, 63, 66

(56) References Cited

U.S. PATENT DOCUMENTS

| | | | | |
|---|---|---|---|---|
| 3,988,019 | A | 10/1976 | Achelpohl | |
| 4,190,185 | A | 2/1980 | Thate | |
| 4,850,583 | A | 7/1989 | Monday | |
| 5,336,004 | A | 8/1994 | Harada et al. | |
| 5,373,312 | A | 12/1994 | Fujioka et al. | |
| 5,410,283 | A | 4/1995 | Gooray et al. | |
| 5,502,464 | A | 3/1996 | Takahashi et al. | |
| 5,534,897 | A | 7/1996 | Anderson et al. | |
| 5,631,685 | A | 5/1997 | Gooray et al. | |
| 5,673,910 | A | 10/1997 | Wamsley | |
| 5,685,539 | A | 11/1997 | Janatka et al. | |
| 5,718,172 | A | 2/1998 | Ruckmann et al. | |
| 5,772,202 | A | 6/1998 | Singer et al. | |
| 5,812,153 | A * | 9/1998 | Watanabe et al. | 347/3 |
| 5,897,114 | A | 4/1999 | Arikawa et al. | |
| 5,992,994 | A | 11/1999 | Rasmussen et al. | |
| 6,068,368 | A | 5/2000 | Lum et al. | |
| 6,092,891 | A | 7/2000 | Okubo et al. | |
| 6,132,122 | A | 10/2000 | Robinson et al. | |
| 6,139,140 | A | 10/2000 | Rasmussen et al. | |
| 6,142,619 | A | 11/2000 | Miura et al. | |
| 6,217,145 | B1 | 4/2001 | Ito et al. | |
| 6,238,115 | B1 | 5/2001 | Silverbrook et al. | |
| 6,267,518 | B1 * | 7/2001 | Abe | 400/188 |
| 6,293,196 | B1 | 9/2001 | DeMoore et al. | |
| 6,293,670 | B1 * | 9/2001 | Taniguro et al. | 347/104 |
| 6,308,626 | B1 | 10/2001 | Crystal et al. | |
| 6,340,225 | B1 | 1/2002 | Szlucha | |
| 6,386,535 | B1 | 5/2002 | Silverbrook et al. | |
| 6,398,438 | B1 * | 6/2002 | Kim et al. | 400/624 |

FOREIGN PATENT DOCUMENTS

| | | |
|---|---|---|
| DE | 2344227 | 3/1975 |
| DE | 19629072 A | 1/1998 |
| JP | 7-323533 A | 12/1995 |
| JP | 8-323959 A | 12/1996 |
| JP | 10-207575 A | 8/1998 |

* cited by examiner

*Primary Examiner*—Andrew H. Hirshfeld
*Assistant Examiner*—Kevin D. Williams

(57) ABSTRACT

A print engine for a printer includes a support structure. A pair of drive rollers is rotatably mounted on the support structure and is configured to define a gripping zone into which a sheet of print medium can be fed to be gripped between the rollers. The drive rollers define a feed zone between the gripping zone and a tangential plane common to both drive rollers through which the sheet of print medium passes. The print engine has at least one print head assembly that includes at least one print head chip carrier that is mounted on the support structure and which is configured to extend into the feed zone. At least one print head chip is mounted on each print head carrier to be in an operative position with respect to the sheet of print medium in the feed zone.

3 Claims, 15 Drawing Sheets

PRINT ENGINE FOR A MODULAR COMMERCIAL PRINTER

This is a Continuation of U.S. Ser. No. 09/662,210 filed on Sep. 15, 2000

1.) Field of the Invention

This invention relates to a modular printer. The invention relates particularly, but not necessarily exclusively, to a modular commercial printer for effecting high speed, digital, photographic quality, commercial printing. The invention relates specifically to a print engine for a modular commercial printer.

2.) Background to the Invention

In high-speed printing, large printing presses are daisy-chained together to print predetermined pages of publications, which are then secured together to form the publications. Such printing presses occupy an extremely large volume and are very expensive.

The applicant has also proposed a commercial printer using a number of floor-mounted printers having pagewidth print heads. This commercial printer is intended for extremely high production rates such as up to five 180-page documents per second.

To achieve such high production rates, large quantities of consumables need to be readily available for the printers. Thus, once again, such a commercial printer needs to occupy an extremely large volume although the cost of such a printer is considerably lower than equivalent high end, commercial printers which do not use the applicant's Memjet (Memjet is a trade mark of Silverbrook Research Pty Ltd) technology.

The applicant has recognised a need for a commercial printer which occupies a smaller volume and which has a lower throughput rate but of the same quality as the applicant's previously proposed Memjet commercial printer.

SUMMARY OF THE INVENTION

According to the invention, there is provided a print engine for a printer, the print engine comprising a support structure;

a pair of drive rollers that are rotatably mounted on the support structure and are configured to define a gripping zone into which a sheet of print medium can be fed to be gripped between the rollers, the drive rollers defining a feed zone between the gripping zone and a tangential plane common to both drive rollers through which the sheet of print medium passes; and at least one print head assembly that comprises at least one print head chip carrier that is mounted on the support structure and which is configured to extend into the feed zone; and at least one print head chip that is mounted on each print head carrier to be in an operative position with respect to the sheet of print medium in the feed zone.

The print engine may include at least one pair of substantially identical print head assemblies, the at least one print head chip carrier of one print head assembly being mirrored by the at least one print head chip carrier of another print head assembly so that the print head chips can be operatively positioned with respect to both sides of the sheet of print medium.

Each print head assembly may include two substantially identical print head chip carriers so that a first pair of carriers is mirrored by a second pair of carriers and the print head assemblies together define a distal pair of mirrored carriers and a proximal pair of mirrored carriers relative to the gripping zone, at least the print head chips mounted on the proximal pair of carriers being positioned in the feed zone.

The at least one print head chip carrier may have an arcuate end profile that corresponds generally with the curvature of a periphery of each drive roller.

The invention extends to a printer that includes at least one print engine as described above.

Each print head chip carrier may include a molding. Each molding preferably defines a plurality of galleries for supplying different inks to its associated print head chip. In this specification the term "ink" is to be understood in a broad sense as including visible inks of various colors, an ink which is invisible in the visible spectrum but is visible in the infrared spectrum, a fixative for fixing the ink on the print media and a varnish for coating printed matter on the print media.

Each molding may include an air channel for feeding filtered air to the print chips for inhibiting the build up of debris and foreign matter on the print chips.

The assembly may include a control means for controlling operation of the, or each print head chip, said control means being mounted on said at least one molding and communicating with said print head chip via a connector. The connector may be a flexible PCB wrapped about a part of a periphery of said at least one molding. In the case where two moldings are provided, each molding may have a flex PCB associated therewith wrapped about a part of its periphery. Preferably, the flex PCB is wrapped about a convex part of a periphery of each molding.

It will be appreciated that, by having each molding substantially scythe shaped, when view end-on, the print head chips of the moldings are brought into close proximity to a rotational axis of the feed means thereby enabling a closely controlled print media to print head gap to be maintained.

BRIEF DESCRIPTION OF THE DRAWINGS

The invention is now described, by way of example, with reference to the accompanying drawings in which.

DETAILED DESCRIPTION OF THE DRAWINGS

Figure 1:
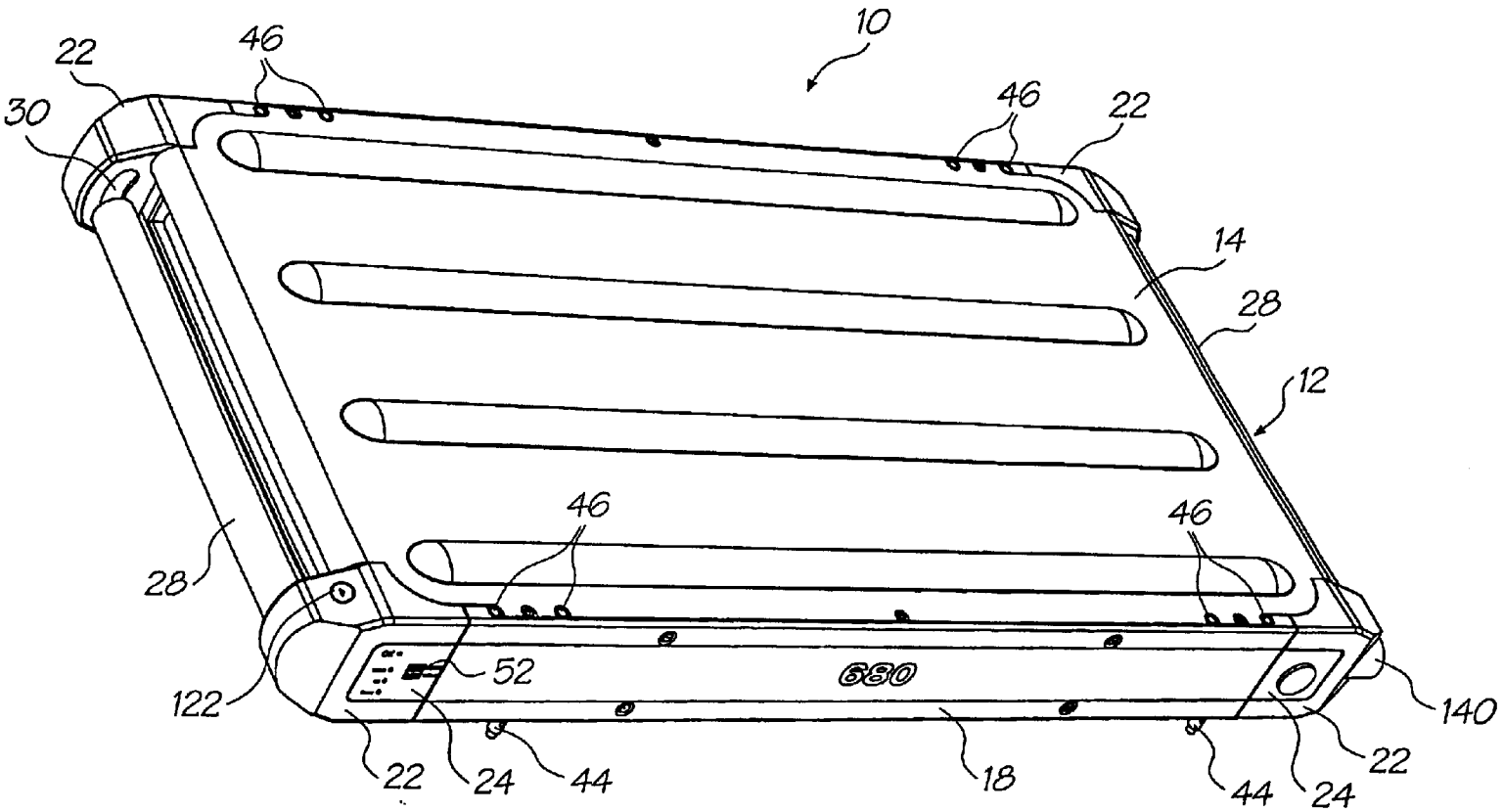
FIG. 1 shows a three dimensional view of a printer, in accordance with the invention that includes a print head assembly, also in accordance with the invention.
Figure 4:
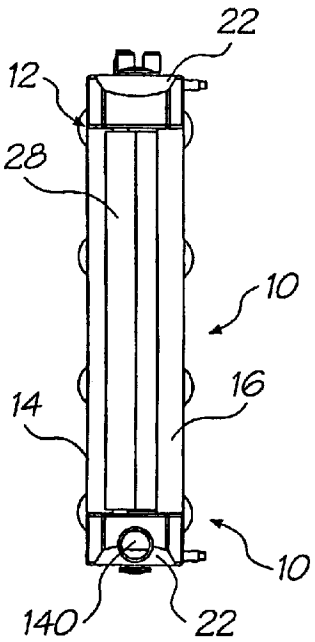
FIG. 4 shows an end view of the printer.
Figure 2:
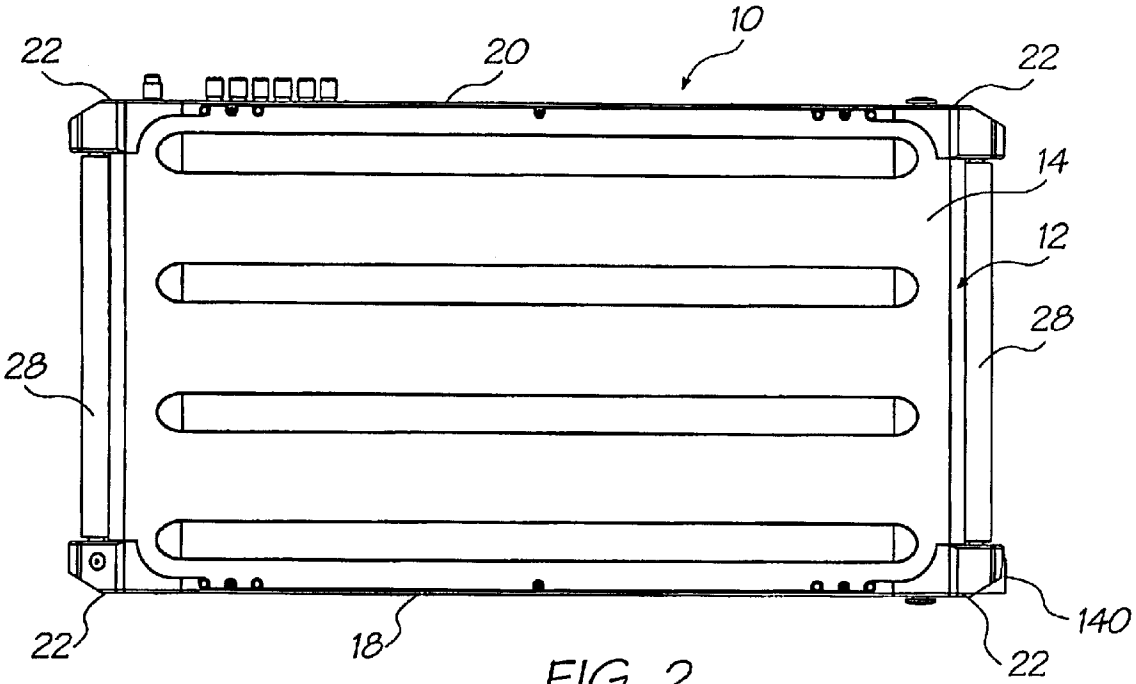
FIG. 2 shows a plan view of the printer.
Figure 3:
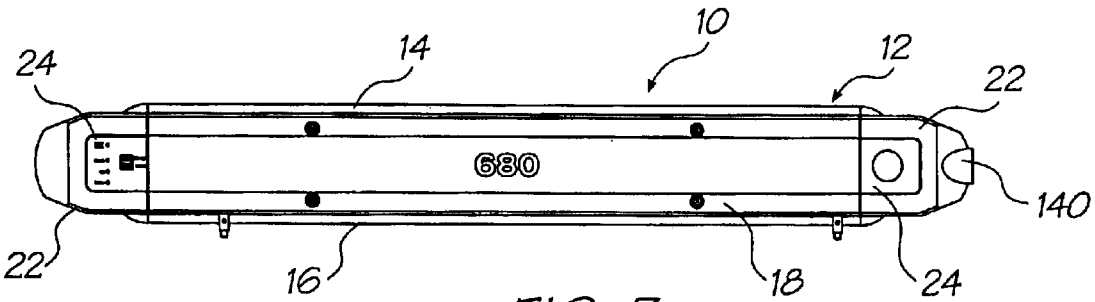
FIG. 3 shows a side view of the printer.

Referring to the drawings, reference numeral 10 generally designates a printer, in accordance with the invention. The printer 10 is a modular printer to be used in combination with other, identical printers, as will be described in greater detail below for effecting high speed, digital, photographic quality, commercial printing. Arrays of the printers 10 can be combined to provide scalable printing systems. However, single printers 10 may also be used individually, if desired.

Figure 9:
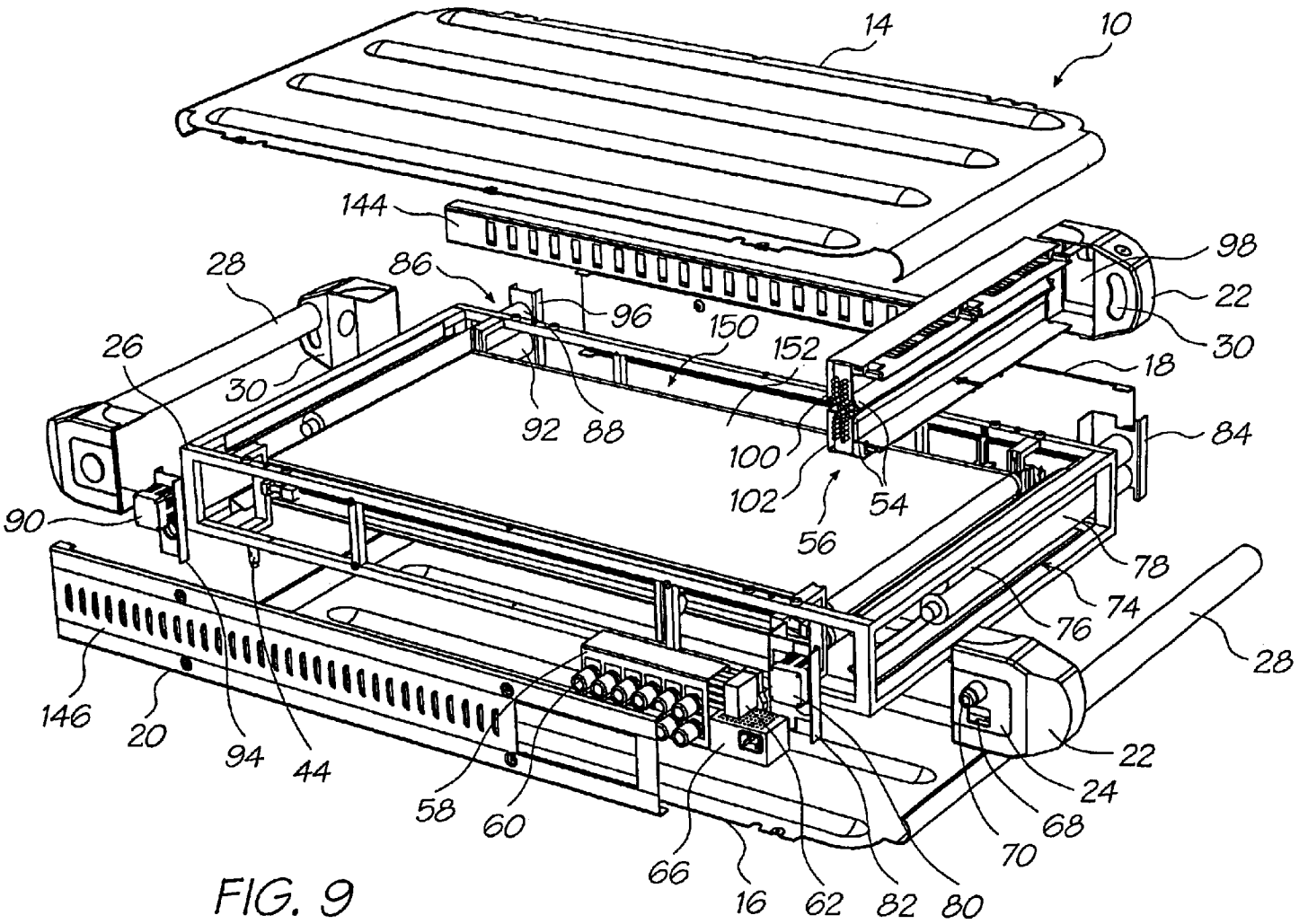
FIG. 9 shows a three dimensional, exploded view of the printer.

The printer 10 comprises a housing 12. The housing 12 is made up of an upper cover 14, a lower cover 16 (FIG. 9), a first side wall 18 and a second, opposed side wall 20 (FIG. 9). Each side wall 18, 20 terminates in an end cap or cheek molding 22. Each cheek molding 22 is the same to reduce the costs of production of the printer 10. Each cheek molding 22 has a slot in which an application-specific insert 24 is received.

The housing 12 surrounds a frame 26. Internal components of the printer 10 are supported on the frame 26.

Opposed cheek moldings 22 at each end of the housing 12 support a guide roller 28 adjustably between them. Thus, each cheek molding 22 defines an arcuate slot 30 within which an axle of its associated roller 28 is received.

Figure 5:
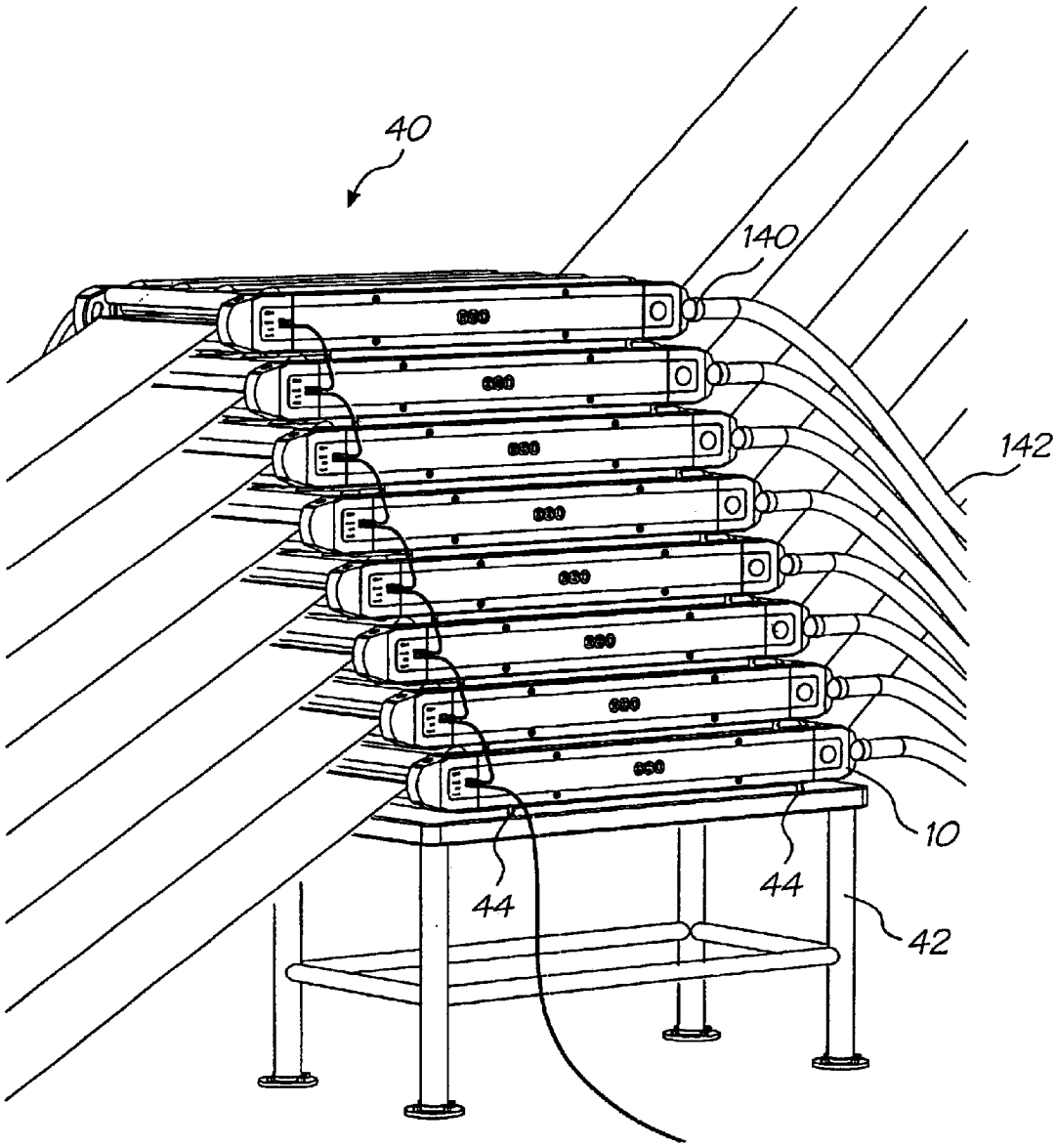
FIG. 5 shows a three dimensional view of a printer stack, in accordance with one embodiment of the invention.
Figure 6:
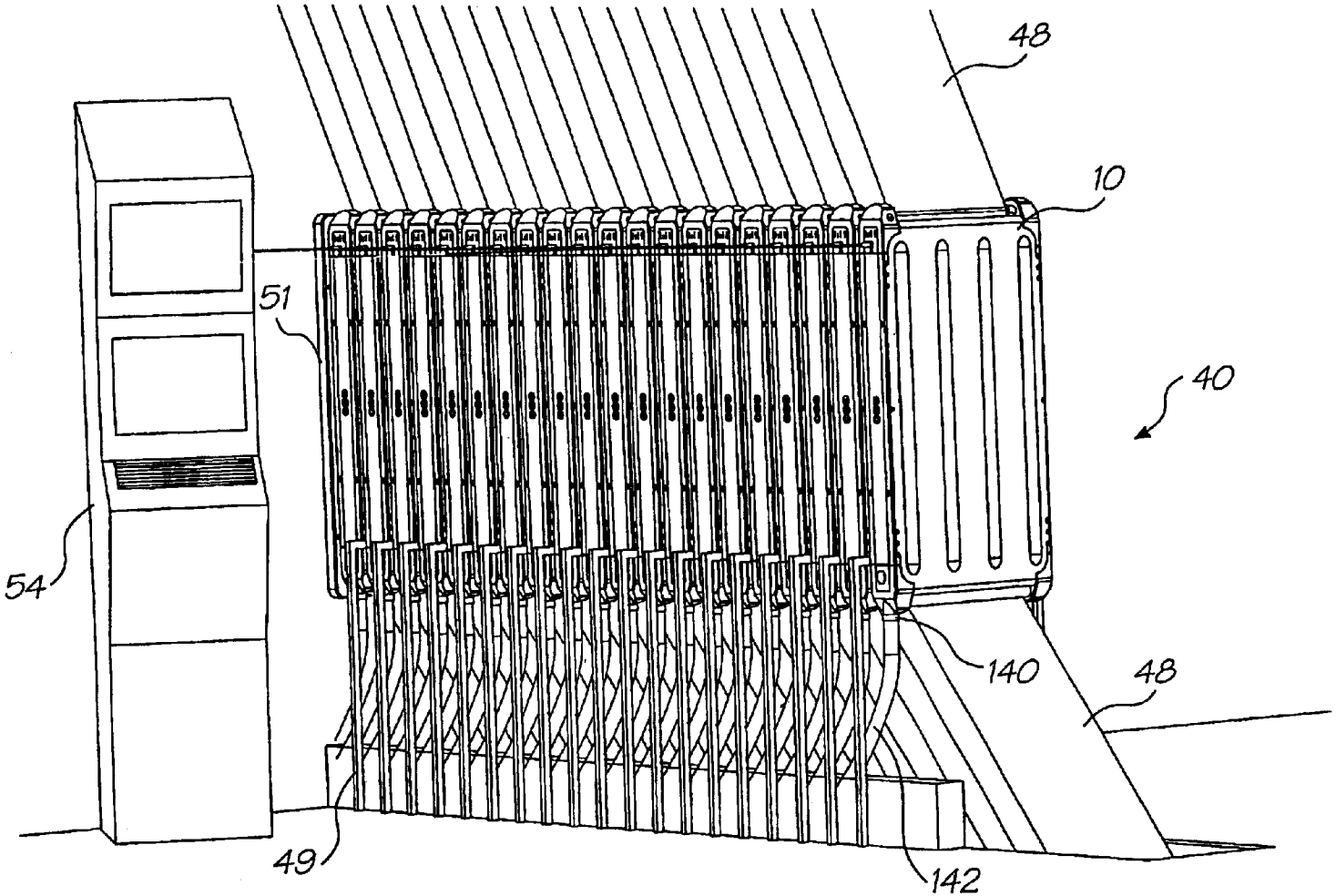
FIG. 6 shows a three dimensional view of a printer stack, in accordance with another embodiment of the invention.

As described above, it is intended that, for commercial printing applications, a plurality of the printers 10 will be used together. As illustrated in FIGS. 5 and 6 of the drawings, the printers 10 are stacked together to form a stack 40. In the embodiment illustrated at FIG. 5, the stack 40 is arranged on a support table 42. A lowermost printer 10 in the stack 40 is locked to the table 42 by means of locking feet 44 of the printer 10. The locking feet 44 of each subsequent printer 10 in the stack 40 are received in associated holes 46 in a top of a subjacent printer 10. Each locking foot 44 has a bayonet fitting so that, when the foot 44 is inserted into one of the holes 46 of the subjacent printer or the table 42, as the case may be, a quarter turn of the foot 44 locks the upper printer 10 with respect to the subjacent printer 10 or the table 42.

As illustrated in FIG. 5 of the drawings, the printers 10, when stacked horizontally, may be offset with respect to each other by locking the locking feet 44 of one printer 10 into the appropriate holes 46 of the subjacent printer. Hence, a plurality of serially aligned holes 46 is arranged adjacent each cheek molding 22. By appropriate selection of the holes 46, the requisite degree of offset, if any, can be achieved.

The offset stacking of the printers 10 allows print media, such as paper 48, to be fed from unwinders (not shown) into each of the printers 10 at a predetermined angle and to be fed out of the printers 10 at a suitable exit angle. If the paper 48 is to be fed in and out of the printers 10 horizontally, the printers 10 of the stack 40 are vertically aligned with respect to each other.

In FIG. 6, another embodiment of the stack 40 is shown. In this embodiment, the printers 10 are arranged vertically and are spaced horizontally with respect to each other. In the example illustrated, paper 48 is fed into each printer 10 at an upper end of the printer and is fed out, after printing, through a bottom of each printer 10. The stack 40 is supported on a framework 49 with the printer at one end of the stack 40 being locked to an end plate 51 of the framework 49 via its locking feet 44. Adjacent printers 10 in the stack 40 are locked together by inserting the locking feet 44 of one printer 10 into the appropriate holes 46 of the adjacent printer 10. A control console 54 is provided for controlling operation of the printer stack 40.

Each printer 10 communicates with its controller and with other printers in the stack 40 via a USB2 connection 50 received in a double USB port arrangement 52. The port arrangement 52 has an inlet port and an outlet port for enabling the printers 10 of the stack 40 to be daisy-chained together and to communicate with each other.

Figure 7:
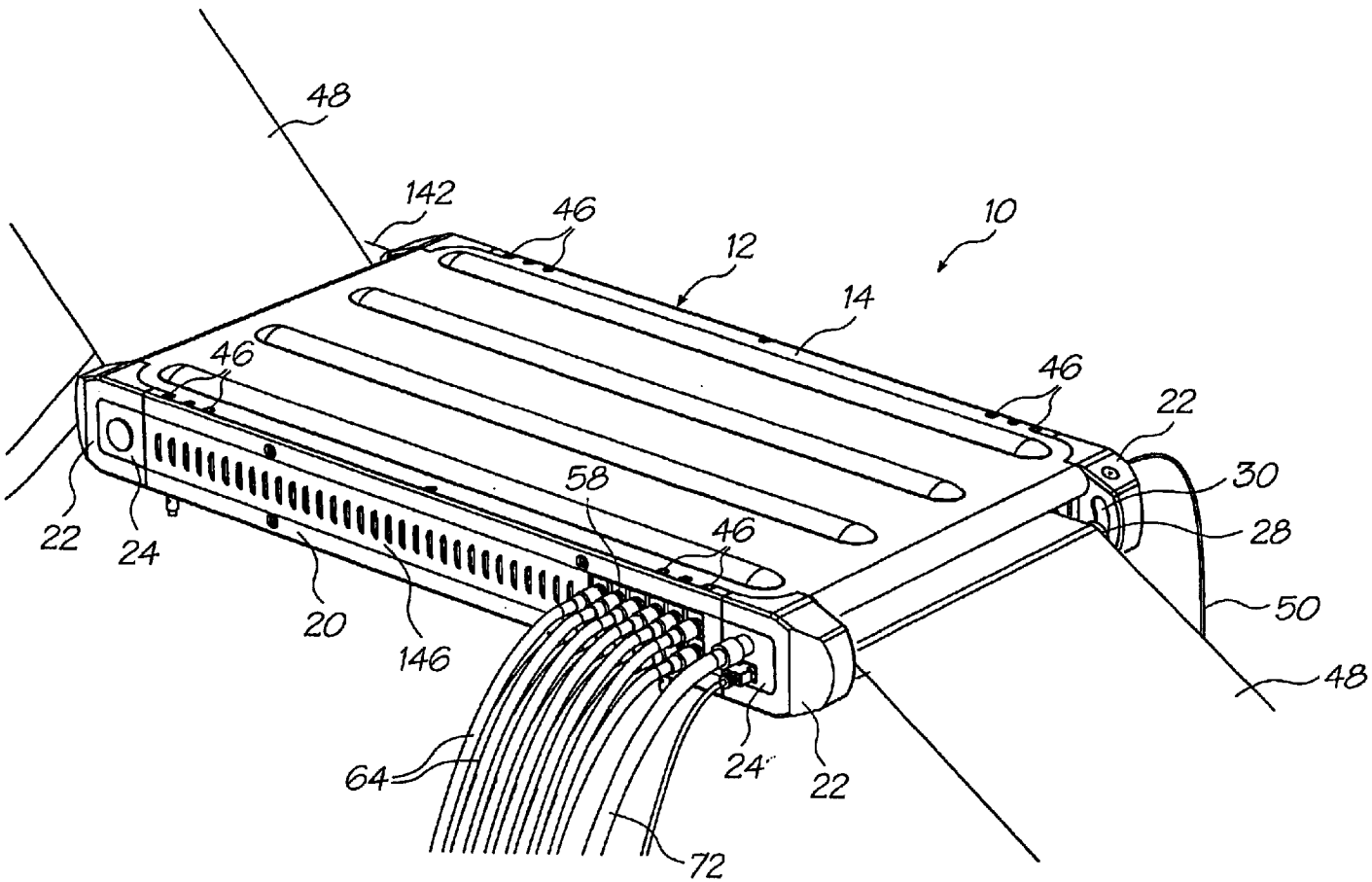
FIG. 7 shows a three dimensional view of the printer including its fluid connections.

Each printer includes a print engine 56, in accordance with the invention, made up of a pair of opposed print head assemblies 54 for enabling double-sided printing to be effected. The print head assembly 54 (FIG. 11) of the print engine 56 of the printer 10 can print in up to twelve colors. As will be described in greater detail below, each print head assembly 54 is a duplexed print head so that, if desired, six colors, duplicated, can be printed by each print head assembly 54. Ink is fed to the print engine 56 via an ink coupling box 58. The coupling box 58 supports twelve ink couplings 60 thereon. Ink hoses 64 are coupled to the coupling box 58 via the couplings 60 and communicate with the print head assemblies 54 of the print engine 56 via an ink connector 62 (FIG. 9). A power connection port 66 is also supported on the ink coupling. The port 66 is received through an opening 68 in one of the inserts 24 of one of the cheek moldings 22. The same insert 24 supports an air coupling 70. An air hose 72 (FIG. 7) feeds air to the print head assemblies 54 of the print engine 56 to maintain print head nozzles (not shown) of the print head assemblies 54 free of debris and foreign matter.

A roller assembly 74 is mounted at an inlet end of the printer 10. The roller assembly 74 includes a drive roller 76 and a driven roller 78. A drive motor 80 supported on a metal bracket 82 drives the drive roller 76. A corresponding bracket 84 at an opposed end of the roller assembly 74 mirrors the metal bracket 82. The brackets 82 and 84 are supported on the frame 26.

In addition, a similar, exit roller assembly 86 is provided at an outlet end of the printer 10. Once again, the roller assembly 86 has a drive roller 88 driven by a drive motor 90 and a driven roller 92. The rollers 86 and 92 are supported between metal brackets 94 and 96. The brackets 94 and 96 are secured to the frame 26. The bracket 94 also supports the motor 90.

The drive roller 76 drives the driven roller 78 via a set of helical gears 132. A similar arrangement applies in respect of the roller 88 and 92 of the roller assembly 86.

The cheek molding 22, at the inlet end of the printer 10, opposite the molding 22 supporting the air coupling 70, also supports a USB control PCB 98.

The print engine 56 is supported by a chassis comprising a pair of opposed metal brackets 100, 102 mounted downstream (in a direction of feed of the paper) of the roller assembly 74. Each metal bracket 100, 102 supports one of the print head assemblies 54 of the print engine 56.

Figure 10:
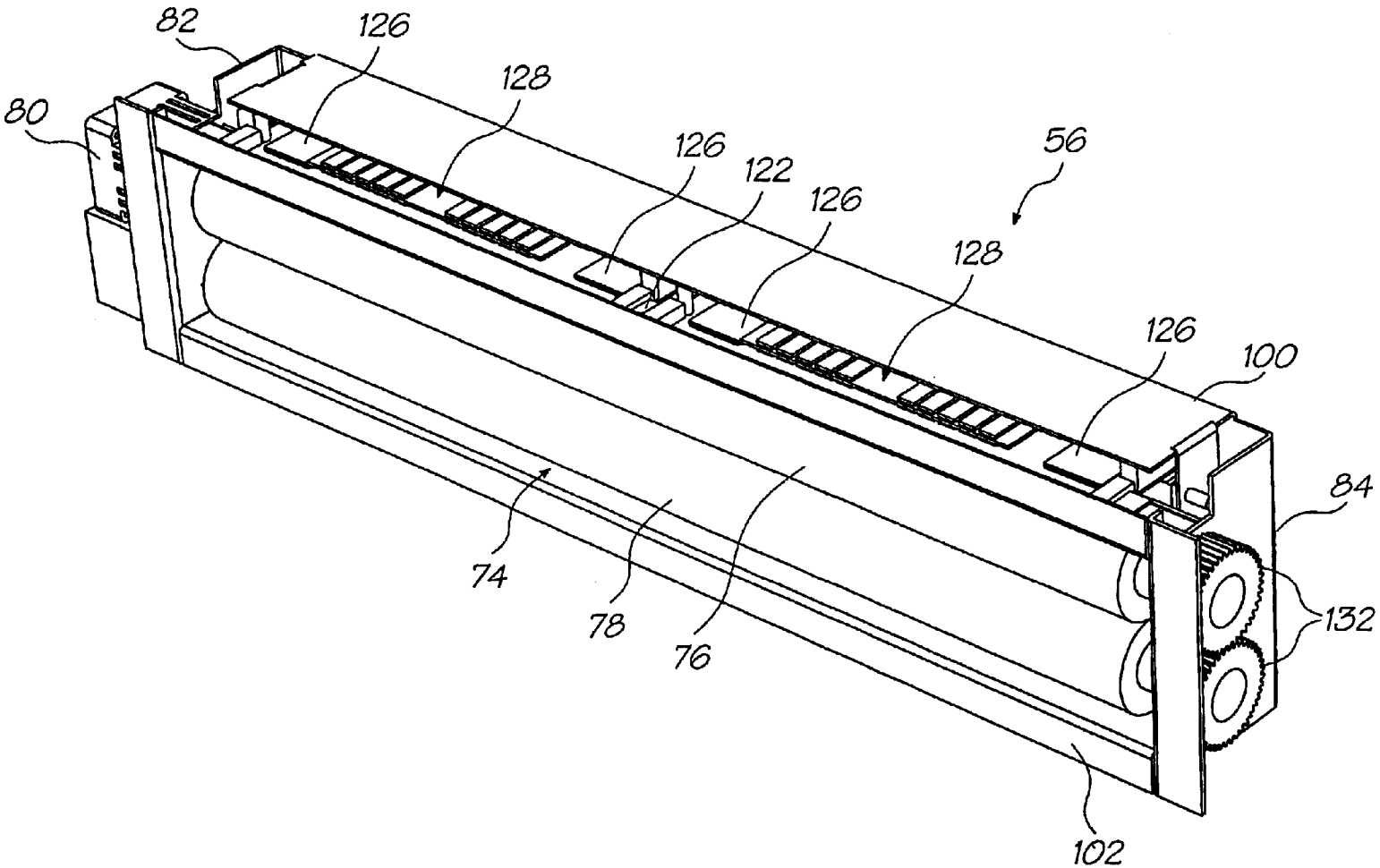
FIG. 10 shows a three dimensional view of a print engine of the printer.
Figure 11:
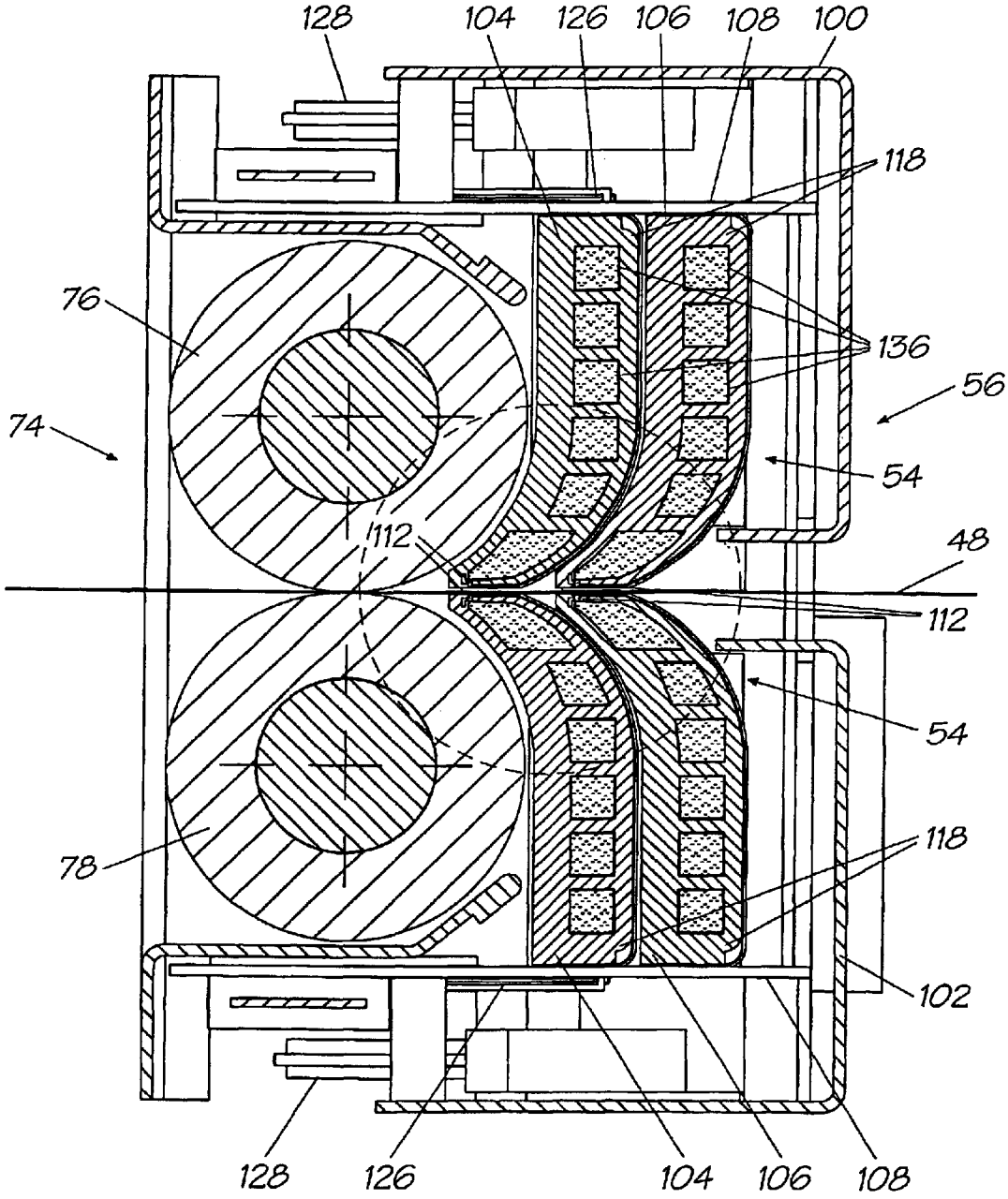
FIG. 11 shows a sectional end view of the print engine.
Figure 12:
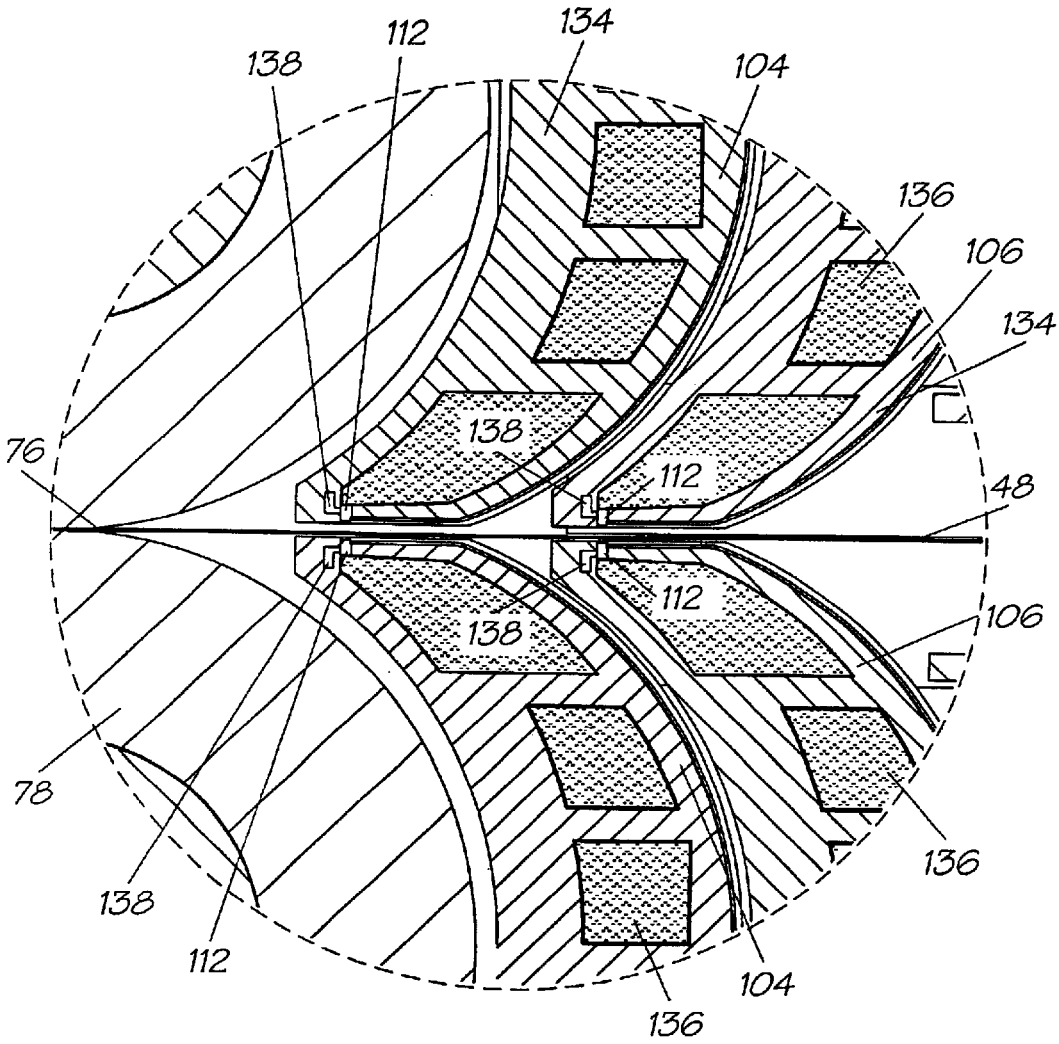
FIG. 12 shows, on an enlarged scale, part of the print engine.

The print engine 56 is shown in greater detail in FIGS. 10 to 12 of the drawings. As described above, the print engine 56 comprises two print head assemblies 54. The print head assemblies 54 are arranged in opposed relationship to enable double sided printing to be effected. In other words, the paper 48 passes between the print head assemblies 54. The brackets 100, 102 support the print head assemblies 54 and position the print head assemblies 54 approximately 0.75 mm apart from the web of paper 48. This distance is automatically adjusted by the brackets 100, 102 to maintain constant spacing with varying paper thickness.

In addition, as will be described in greater detail below, print heads of the print head assemblies 54 are so designed as to allow for close proximity to the rollers 76 and 78 resulting in a closely controlled paper to print head gap.

Each print head assembly 54 comprises a first print head 104 that includes a print head chip carrier and a second, adjacent print head 106 that also includes a print head chip carrier. Thus, the two print heads 104 define a proximal mirrored pair of print heads and the two print heads 106 define a distal mirrored pair of print heads with respect to the rollers 76, 78. Each roller 76, 78 has a diameter of about 2 cm. It follows that print head chips 112 of the proximal pair of print heads are less than 1 cm from a gripping zone defined by the rollers 76, 78.

Each print head 104, 106 is made up of two modules 104.1 and 104.2 and 106.1 and 106.2, respectively. The modules 104.1 and 106.1 are coupled together and are controlled by a first printed circuit board (PCB) 108. Similarly, the modules 104.2 and 106.2 are coupled together and are controlled by a second printed circuit board (PCB) 110. PCB's 108 and 110 communicate with the print head chips 112 of the print heads 104 and 106 via flexible PCB's 114. These flexible PCB's 114 terminate in terminal pads 116 on moldings 118 of the modules 104.1, 104.2, 106.1 and 106.2 of the print heads 104 and 106. The terminal pads 116 communicate with corresponding pads (not shown) of the PCB's 108, 110.

It is to be noted that the moldings 118 are mirror images of each other, each having ink inlets 120 at a free end thereof. Ink is fed in at one end of interconnected moldings 118 only so that the inlets 120 not being used are plugged by appropriate plugs. Also, the PCB's 108, 110 are mirror images of each other. This reduces the cost of production of the printer 10 and also enables rapid and easy assembly of the printer 10. The PCB's 108 and 110 communicate with each other via a serial cable 122. One of the PCB's 108, 110 is connected via a connector 124 to the USB circuit board 98.

Each PCB 108, 110 includes two print engine controllers (PEC's) 126 and associated memory devices 128. The memory devices 128 are dynamic random access memory (DRAM) devices.

Figure 13:
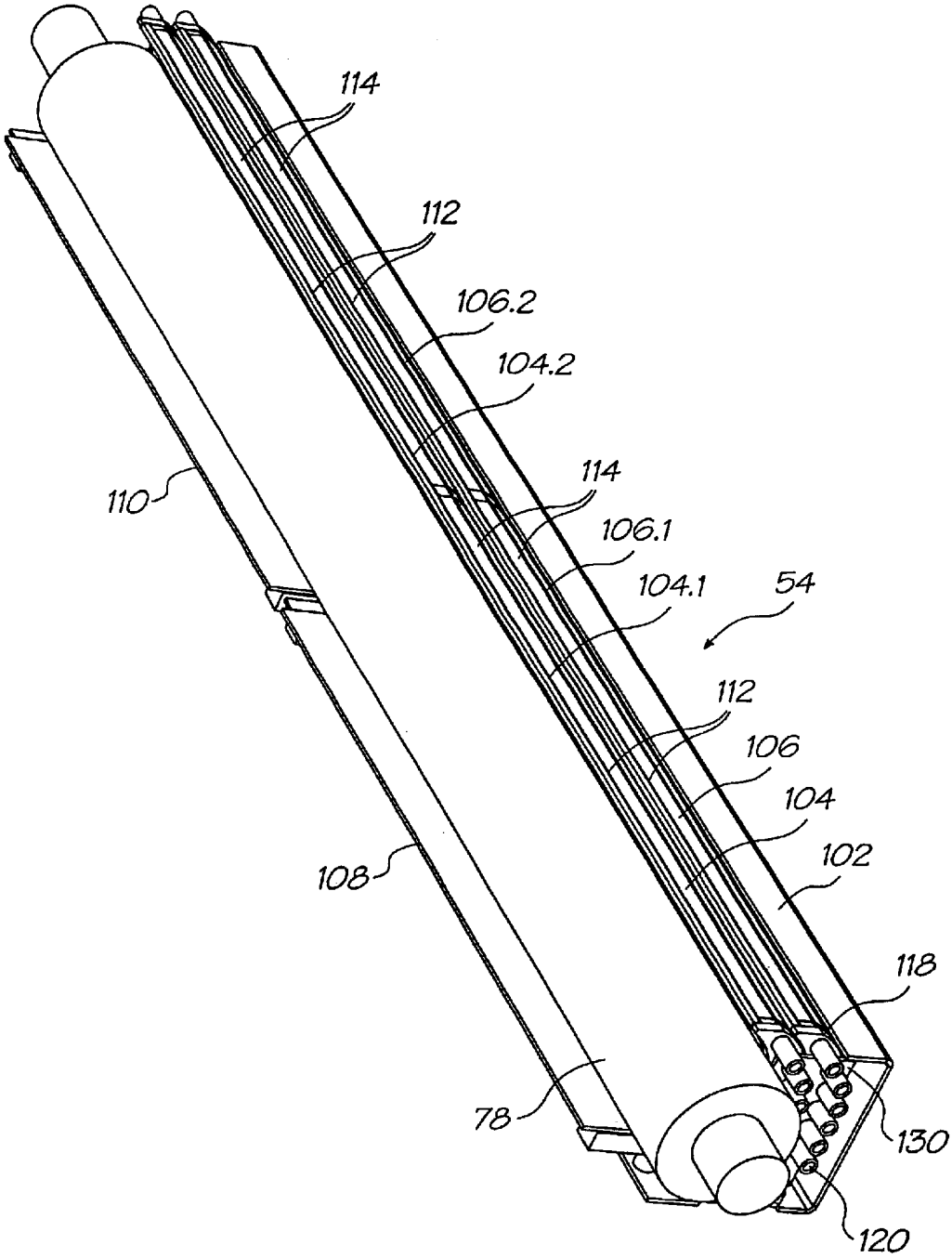
FIG. 13 shows a three dimensional view of one of the print head assemblies of the print engine.
Figure 14:
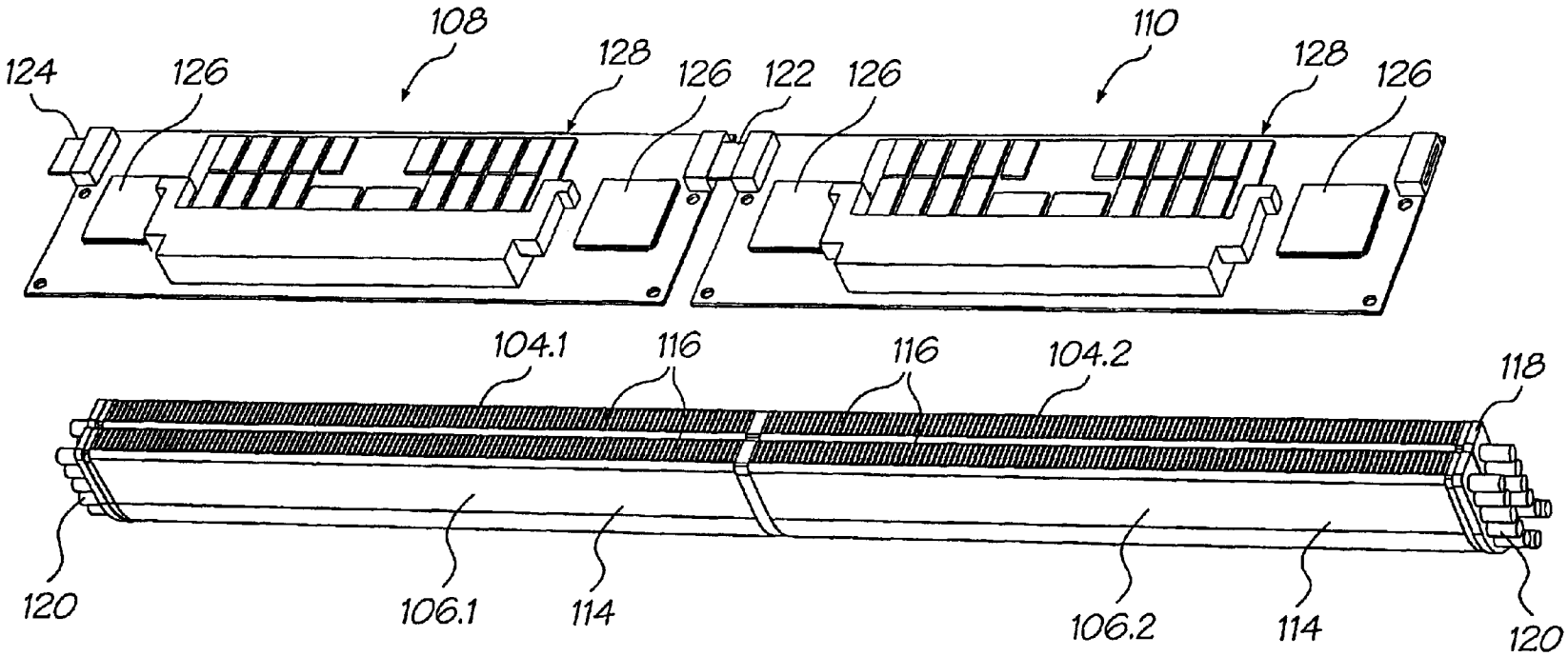
FIG. 14 shows a three dimensional, exploded view of one of the print head assemblies.
Figure 15:
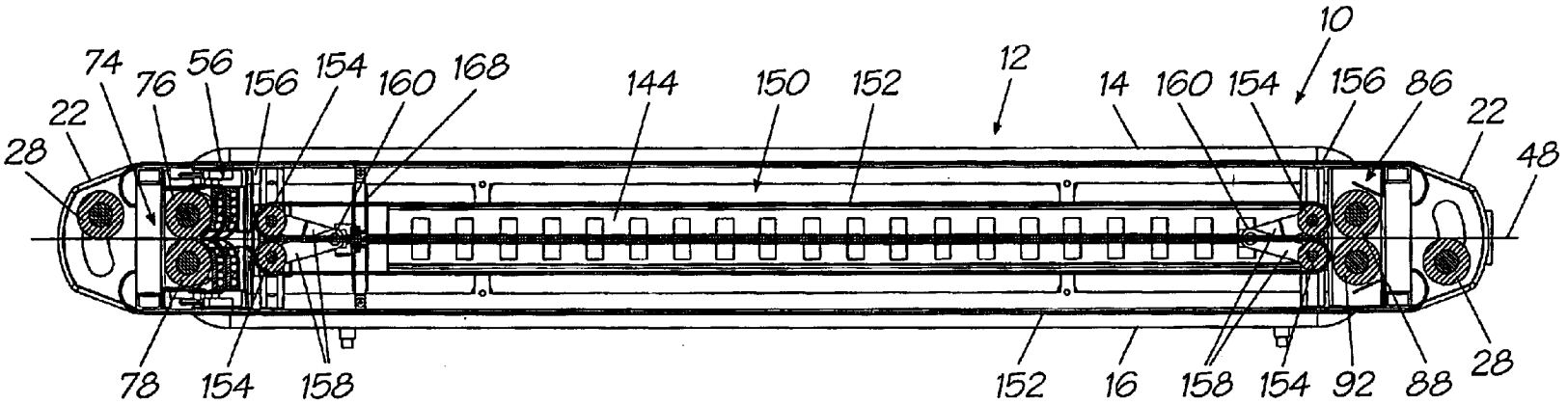
FIG. 15 shows a sectional side view of a print media loading mechanism of the printer, in its loading configuration.
Figure 16:
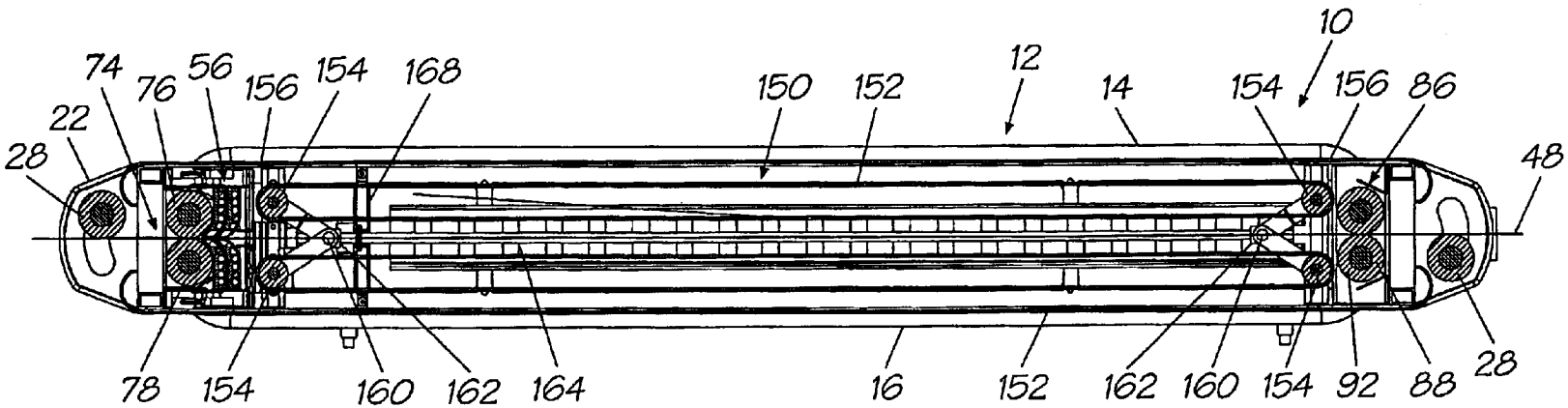
FIG. 16 shows a sectional side view of the loading mechanism of the printer in its open, non-loading configuration.
Figure 17:
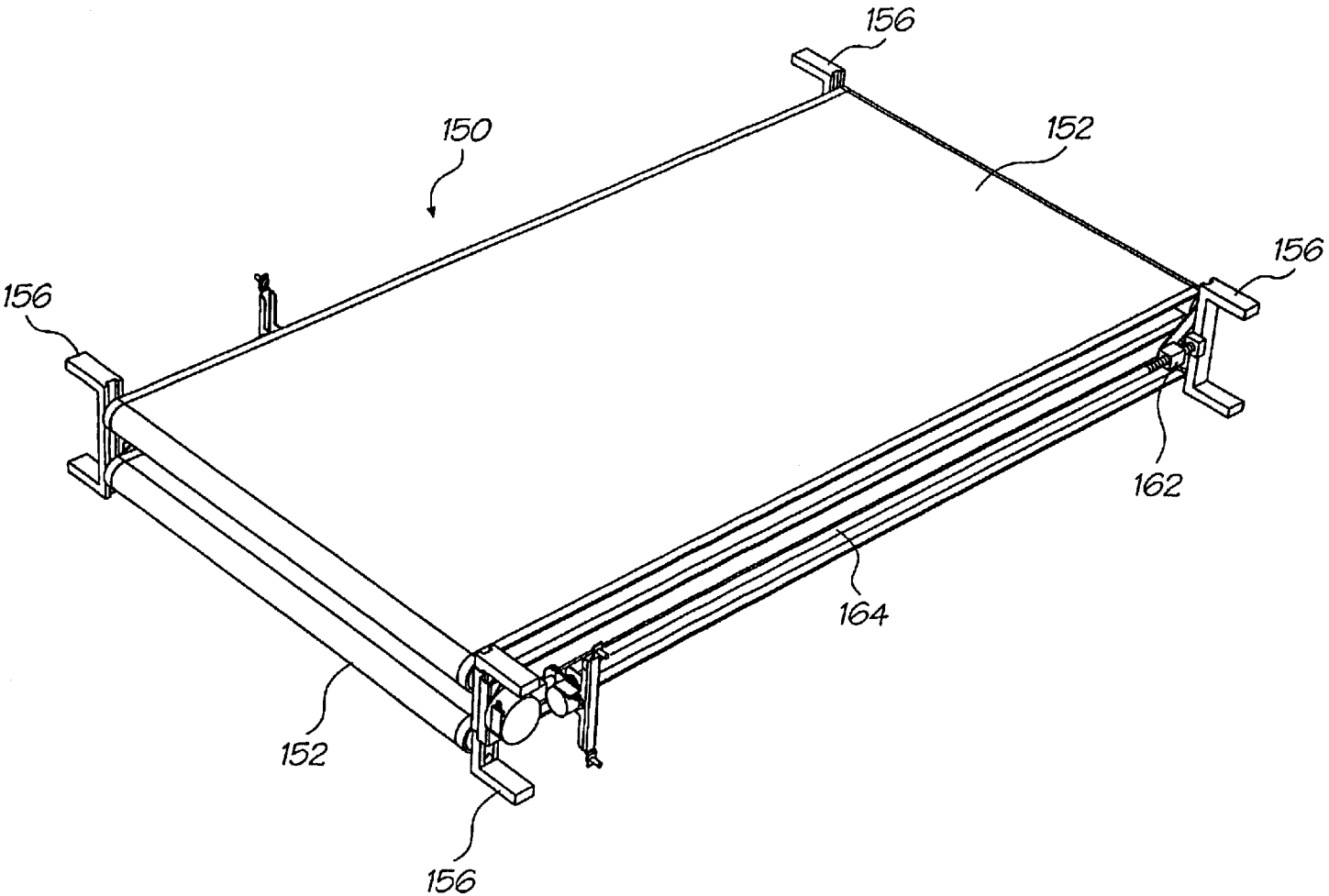
FIG. 17 shows a three dimensional view of the loading mechanism in its non-loading configuration.

The molding 118 of each print head assembly 54 is supported on the frame 100, 102 via an end plate 130 (FIG. 13).

The print engine 56 is shown in greater detail in FIG. 11 of the drawings. The print engine 56 comprises the two print head assemblies 54. As previously described, each print head assembly 54 comprises two print heads 104, 106. Each print head 104, 106 has a print head chip 112 associated therewith. The print head chips 112 of the print heads 104, 106 are supported along a longitudinal edge portion of the moldings 118.

The edge portion of each molding 118 that carries the print head chip 112 is arcuate. The arcuate portion of each molding 118 has a radius of curvature that approximates that of the radius of the rollers 76, 78. This design of the print heads 104, 106 allows for close proximity of the print head chips 112 to the rollers 76, 78 resulting in a closely controlled paper to print head gap. In so doing the printhead chip 112 prints in a portion of the paper, which is taut, resulting in a more accurate deposition of ink drops on the paper 48.

As illustrated more clearly in FIG. 12 of the drawings, an air channel 138 is arranged adjacent each print head chip 112 for feeding air to the print head chip 112 from the air hose 72.

With this arrangement of print head assemblies 54, either six colors or twelve colors can be printed. Where six colors are to be printed, these are duplicated in the print heads 104, 106 of each assembly 54 by having the appropriate colored ink or related matter (referred to for convenience as "colors") in the relevant galleries 136 of the moldings 118. Instead, each print head assembly 54 can print the twelve "colors" having the appropriate "colors" charged into the galleries 136 of the print heads 104, 106. Where six "colors" are to be printed, these are normally cyan, magenta, yellow and black. The remaining galleries 136 then have an ink fixative and a varnish. Where twelve "colors" are to be printed, the "colors" are cyan, magenta, yellow, black, red, green, blue, either three spot colors or two spot colors and infrared ink, and the fixative and the varnish.

The printer 10 is designed so that, where six "colors" are to be printed, the printer can print at a printing speed of up to 1,360 pages per minute at a paper speed of 1.6 m/s. Where twelve "colors" are to be printed, the printer 10 is designed to operate at a printing speed of up to 680 pages per minute at a paper speed of 0.8 m/s.

The high speed is achieved by operating the nozzles of the print head chips 112 at a speed of 50,000 drops per second.

Each print head module 104.1, 104.2, 106.1, 106.2 has six nozzle rows per print head chip 112 and each print head chip 112 comprises 92,160 nozzles to provide 737,280 nozzles per printer. It will be appreciated that, with this number of nozzles, full 1600 dpi resolution can be achieved on a web width of 18.625 inches. The provision of a web width of this dimension allows a number of pages of a document to be printed side-by-side.

In addition, matter to be printed is locally buffered and, as a result, complex documents can be printed entirely from the locally buffered data.

It is also intended that the amount of memory 128 installed on each board 108, 110 is application dependent. If the printers 10 are being used for unchanging pages, for example, for offset press replacement, then 16 megabytes per memory module is sufficient. If the amount of variability on each page is limited to text, or a small range of variable images, then 16 megabytes is also adequate. However, for applications where successive pages are entirely different, up to 1 gigabyte may need to be installed on each board 108, 110 to give a total of 4 gigabytes for the print engine 56. This allows around 2,000 completely different pages to be stored digitally in the print engine 56. The local buffering of the data also facilitates high-speed printing by the printers 10.

The spacing between the print engine 56 and the exit roller assembly 86 is approximately one meter to allow for a one second warm-set ink drying time at a web speed of the paper 48 of approximately 0.8 meters per second. To facilitate drying of the printed images on the paper 48 the fixative is used in one of the ink galleries 136. In addition, warm air is blown into the interior of the printer 10 from a source (not shown) connected to an air inlet 140 (FIG. 1) via an air hose 142. The air inlet communicates with a metal air duct 144 (FIG. 9) that blows the warm air over the paper 48 exiting the print engine 56. Warm air is exhausted from the interior of the printer by means of vents 146 in the side wall 20 of the housing 12 of the printer 10.

The printer 10 includes a print media loading mechanism 150 for loading the paper 48 into the interior of the printer 10. The loading mechanism 150 comprises a pair of opposed endless belts 152 (shown more clearly in FIGS. 15 to 18 of the drawings). Although not illustrated as such, these belts 152 are foraminous to enable the warm air ducted in through the duct 144 to be blown through the belts 152 over both surfaces of the paper 48, after printing, in use.

Each belt 152 passes around a pair of spaced rollers 154. The rollers 154 are held captive to be vertically slidable in slides 156. The slides 156 are mounted on the frame 26 of the printer 10.

Each roller 154 is mounted at one end of an arm 158. The opposed end of each arm 158 is connected at a common pivot point 160 to a traverser block 162 so that the arms 158 are connected to their associated traverser block 162 scissors-fashion. The traverser block 162 is, in turn, mounted on a lead or worm screw 164. A motor 166 supported on a bracket 168 rotatably drives the worm screw 164.

Figure 18:
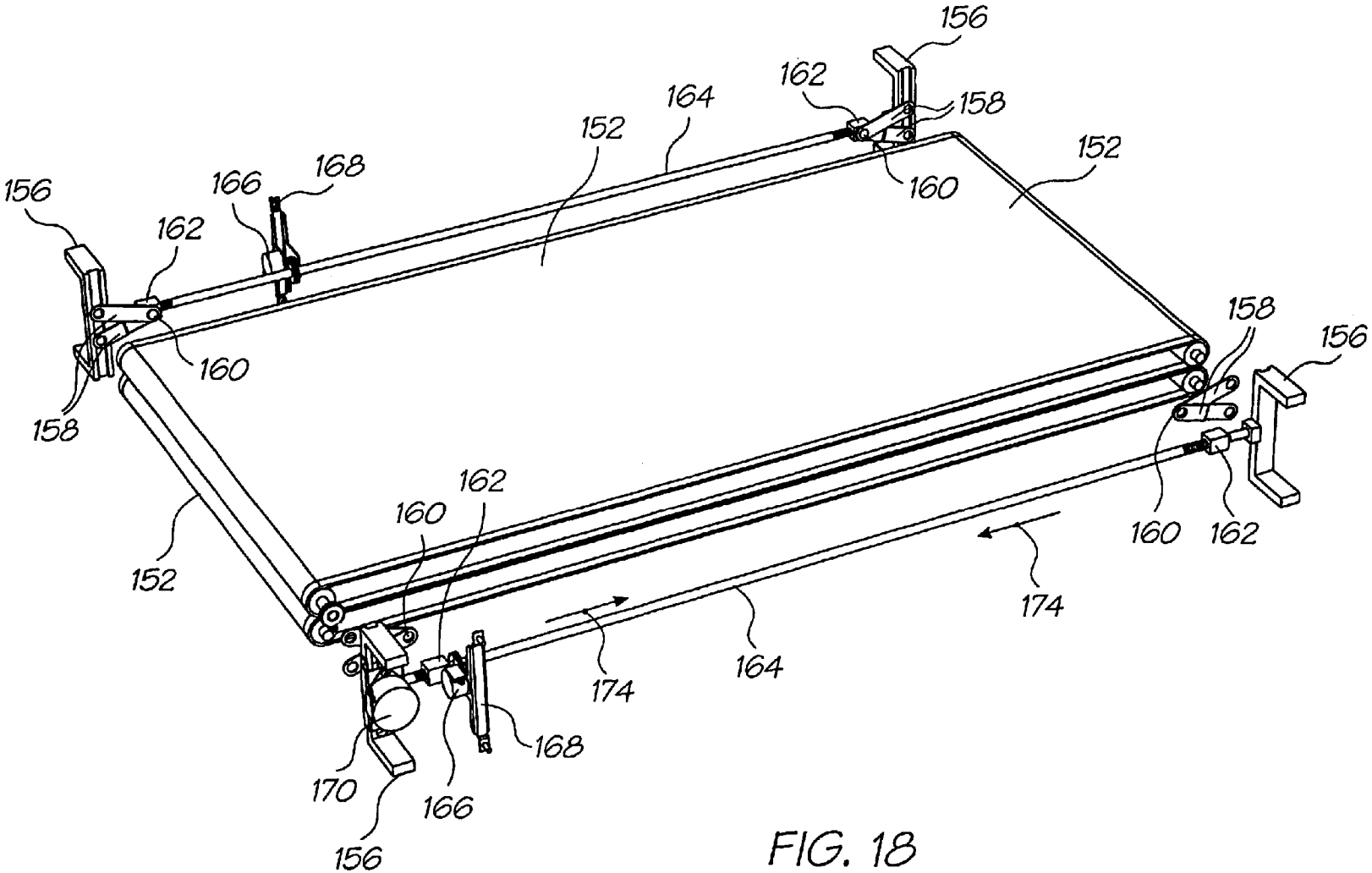
FIG. 18 shows a three dimensional, exploded view of the loading mechanism in its loading configuration.

The rollers 154 are driven by a motor 170 (FIG. 18).

Figure 8:
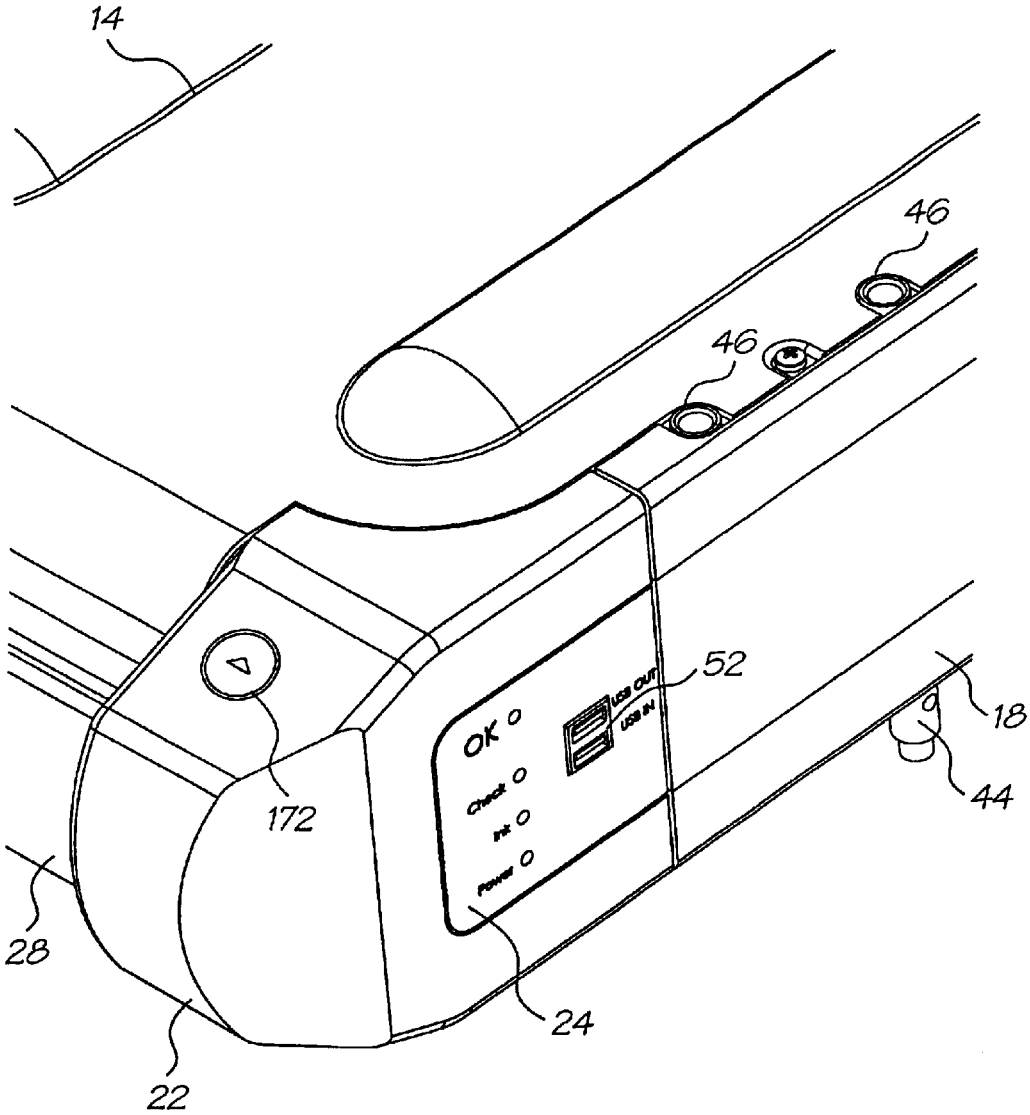
FIG. 8 shows a detailed, three dimensional view of part of the printer.

When it is desired to load paper 48 into the printer 10, the mechanism 150 is operated by a paper load button 172 (FIGS. 1 and 8). This causes the roller motor 170 to be activated as well as the motor 166. Rotation of the motor 166 causes the traverser blocks 162 to move in the direction of arrows 174 to bring the belts 152 into abutment with each other. A leading edge of the paper 48 is fed between the belts 152, is grabbed by the belts 152 and is fed through the printer 10 to exit through the exit roller assembly 86. Once the paper 48 has been loaded, the direction of the motor 166 is reversed so that the traverser blocks move in directions opposite to that of arrows 174 causing the belts 152 to move to the position shown in FIG. 16 of the drawings. Thus, during printing, the belts 152 are spaced from, and do not bear against, surfaces of the paper 48.

Accordingly, by means of the invention, a modular printer that can print at commercial printing speeds is provided for the printing of documents. Several modules can be arrayed in combination with inserting machines for published documents, such as magazines, with variable paperweights. In addition, print module redundancy allows paper splicing on a stopped web with no down time as the other printer modules in the stack 40 take up printing of the pages which would normally be printed by the out of operation printer 10.

Each printer 10 is provided with its document printing requirements over the USB2 communications network (or optional Ethernet) from a workstation such as the console 54.

Also, due to memory capacity of each printer 10, tens of thousands of images and text blocks can be stored in memory allowing completely arbitrary selections on a page-by-page basis. This allows the printing of matter such as catalogues and magazines that are highly customised for each reader.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A print engine for a printer, the print engine comprising a support structure;

a pair of drive rollers that are rotatably mounted on the support structure and are configured to define a gripping zone into which a sheet of print medium can be fed to be gripped between the rollers, the drive rollers defining a feed zone between the gripping zone and a tangential plane common to both drive rollers through which the sheet of print medium passes; and at least print two head assemblies comprises at least two substantially identical print head chip carries mounted on the support structure and which are configured to extend into the feed zone so that a first pair of carriers is mirrored by a second pair of carries; and at least one print head chip that is mounted on each print head chip carrier; and wherein the print head assemblies together define a distal pair of mirrored carriers and a proximal pair of mirrored carriers relative to the gripping zone, at least the print head chips mounted on the proximal pair of carriers being positioned in the feed zone; so as to be in an operative position with respect to the sheet of print medium in the feed zone.

2. A print engine as claimed in claim 1, in which the at least one print head chip carrier has an arcuate end profile that corresponds generally with the curvature of a periphery of each drive roller.

3. A printer that includes at least one print engine as claimed in claim 1.

* * * * *

UNITED STATES PATENT AND TRADEMARK OFFICE

CERTIFICATE OF CORRECTION

PATENT NO. : 6,752,549 B2
APPLICATION NO. : 10/202020
DATED : June 22, 2004
INVENTOR(S) : Kia Silverbrook It is certified that error appears in the above-identified patent and that said Letters Patent is hereby corrected as shown below:

Col. 8, lines 15-42, Claim 1 should read:

--1. A print engine for a printer, the print engine comprising a support structure;

a pair of drive rollers that are rotatably mounted on the support structure and are configured to define a gripping zone into which a sheet of print medium can be fed to be gripped between the rollers, the drive rollers defining a feed zone between the gripping zone and a tangential plane common to both drive rollers through which the sheet of print medium passes; and at least two print head assemblies that comprises at least two substantially identical print head chip carriers mounted on the support structure and which are configured to extend into the feed zone so that a first pair of carriers is mirrored by a second pair of carriers; and at least one print head chip that is mounted on each print head chip carrier and wherein the print head assemblies together define a distal pair of mirrored carriers and a proximal pair of mirrored carriers relative to the gripping zone, at least the print head chips mounted on the proximal pair of carriers being positioned in the feed zone; so as to be in an operative position with respect to the sheet of print medium in the feed zone.

Signed and Sealed this
Twenty-ninth Day of May, 2012

David J. Kappos

David J. Kappos
*Director of the United States Patent and Trademark Office*